US005193802A

United States Patent [19]

Saltus

[11] Patent Number: 5,193,802

[45] Date of Patent: Mar. 16, 1993

[54] PORTABLE, ASYMMETRICALLY DISPLACED, SELF-CENTERING BALL CATCHING AND RETURN APPARATUS AND METHOD

[76] Inventor: James E. Saltus, 2637 Barton Hills Dr., Austin, Tex. 78704

[21] Appl. No.: 824,996

[22] Filed: Jan. 24, 1992

[51] Int. Cl.[5] ..... A63B 69/40

[52] U.S. Cl. ..... 273/26 A; 273/181 F; 273/181 K; 273/55 B

[58] Field of Search ..... 273/26 A, 29 A, 181 F, 273/181 J, 181 K, 182 R, 195 A, 176 F, 400, 55 B

[56] References Cited

U.S. PATENT DOCUMENTS

| | | | |
|---|---|---|---|
| 3,001,795 | 9/1961 | Johnson, Jr. | 273/26 A |
| 3,328,033 | 6/1967 | Hendry | 273/182 R |
| 3,758,116 | 9/1973 | Pieronek | 273/400 |
| 3,856,301 | 12/1974 | Davidson | 273/181 F |
| 3,986,719 | 10/1976 | Lee | 273/181 J |
| 4,511,146 | 4/1985 | Windall | 273/181 F |
| 4,836,542 | 6/1989 | Crawley | 273/181 F |

OTHER PUBLICATIONS

Golf Digest—1960—p. 10.

*Primary Examiner*—Theatrice Brown
*Attorney, Agent, or Firm*—Shaffer & Culbertson

[57] ABSTRACT

A portable ball catcher and return apparatus having an upright frame and a net supported on the frame. The frame is comprised of a horizontal U-shaped base member and an inverted vertically extending U-shaped member attached to the base member. A net having top, bottom and side edges to define a pair of top corners and a pair of bottom corners. The top edge is attached to and along the cross-bar of the vertical U-shaped member and only the bottom corners are attached to a respective leg of the vertical U-shaped member by a loose fitting ring member to allow the rings to move up the leg when a ball impacts the net and move down the legs after the momentum of the ball is stopped by the net, thus causing the ball to roll down the net to the ground and in the direction of a user.

10 Claims, 3 Drawing Sheets

PORTABLE, ASYMMETRICALLY DISPLACED, SELF-CENTERING BALL CATCHING AND RETURN APPARATUS AND METHOD

BACKGROUND OF THE INVENTION

This invention relates to a portable, asymmetrically displaced ball catching and return device.

A wide variety of ball catching and return devices are known in the art. Particularly with regard to football and golf ball catching devices, a number of solutions to the problems of stopping the forward progress of the ball in a short distance and returning it to the user by means of a device that is practical, and functional, have been attempted. In general, the solution has been to construct a net between a frame that is either very massive or stuck in the ground. Some are provided with a momentum absorbing configuration, such as a rocking base, to absorb the impact and momentum of the incoming ball. Examples of such nets are disclosed by La Rose U.S. Pat. No. 4,063,739 in which the frame is actually stuck into the ground and Lee U.S. Pat. No. 3,986,719 in which rockers are utilized to absorb the shock of impact. Another shock absorbing method is simply to provide an excess of net material. Such devices using excess net are shown in Davidson, U.S. Pat. No. 3,856,301 and Crawley, U.S. Pat. No. 4,836,542. Most of these patented devices secure the net at the bottom, and sides or have a rigid bottom edge. Only one, Leneveu, U.S. Pat. No. 4,880,239, has a flexible lower bottom edge that is attached only at two points to the base of the support. The corners of the bottom of the net in Leneveu, however, are only provided limited range of motion along a 45 degree angle from the base to the back of the support. As a result, off center shots, i.e. shots that do not hit in the middle or substantially close to the middle of the net in Leneveu, will ricochet off the net. That is why Leneveu needs side screens.

A drawback to the ball catching devices known in the art is that there is no single device, known to this inventor, that provides impact energy absorption or neutralization which is portable, light weight, easily set up and conveniently stored when not in use and which includes a simple, self-correcting, self-centering reflexive action feature that enables the user to use the device indoors or out and which captures the ball in flight and returns it to the user no matter where the ball impacts the net. Thus, there is a need in the art for providing a portable, self-centering, ball catcher which captures the ball in flight, neutralizes the momentum of the ball, and then gently returns it to the user. It, therefore, is an object of this invention to provide an improved, portable, self-correcting momentum-neutralizing, self-centering, ball catcher so that an approaching ball is arrested, guided back toward the center within the device, and returned to the user for reuse.

SHORT STATEMENT OF THE INVENTION

Accordingly, the portable, asymmetrically displaced, ball catching and return apparatus of the present invention includes a frame and a net attached to the frame. The frame is constructed of a simple U-shaped horizontal member (the base) and the combination of two parallel oppositely positioned upright frame members attached to the U-shaped horizontal member at the bottom. The vertical frame members are connected at the top by a horizontal member (crossbar) so as to form an upwardly standing, backwardly inclining support for a net. The net is slightly longer than the vertical dimension of the frame so it can hang vertically from the top and lay parallel to the floor surface along a portion of the bottom. This is important because it establishes the proper net/floor angle for the ball return aspect to function. It also makes it impossible for a mis-hit ball to go under the net. The net is designed to be attached along its top edge to the highest horizontal part of the upstanding frame (crossbar). The bottom and two sides of the net are not attached to the frame. The two corners of the bottom of the net are slidably attached (with rings, for example) to each adjacent vertical frame member. Each corner attachment, therefore, is free to rise and fall along substantially the entire length of the vertical frame member when the net is driven back by a ball impacting it. Further, there is no excess net required of the invention. That is, the net falls directly down from its connection at the top of the frame until a few inches of it lays flat on the floor or the ground in between the points where the corners are connected to the vertical support members. A target graphic is preferably incorporated with the net so that instant visual feedback is provided for accuracy of the ball's flight path and impact point.

A corresponding asymmetrically displaced catching and ball return method is provided herein as well. The method comprises the steps of constructing a frame, attaching a net, with a top and bottom and two sides, to the frame along the top of the net and slidably attaching two corners of the bottom to the frame so that the bottom and two sides are free to move asymmetrically and independently of each other. A user propels a ball into the net and, if the exact middle is not hit, the net moves asymmetrically to guide the ball toward the center of the net, then lowers the ball to the ground surface and delivers it back toward the user. If the center of net is impacted, the action of the net is generally symmetrical and the ball return functions in the same manner.

BRIEF DESCRIPTION OF THE DRAWINGS

Other objects, features, and advantages of the present invention will become more fully apparent from the following detailed description of the preferred embodiment, the appended claims and the accompanying drawings in which:

DETAILED DESCRIPTION OF THE PREFERRED EMBODIMENT

Figure 9:
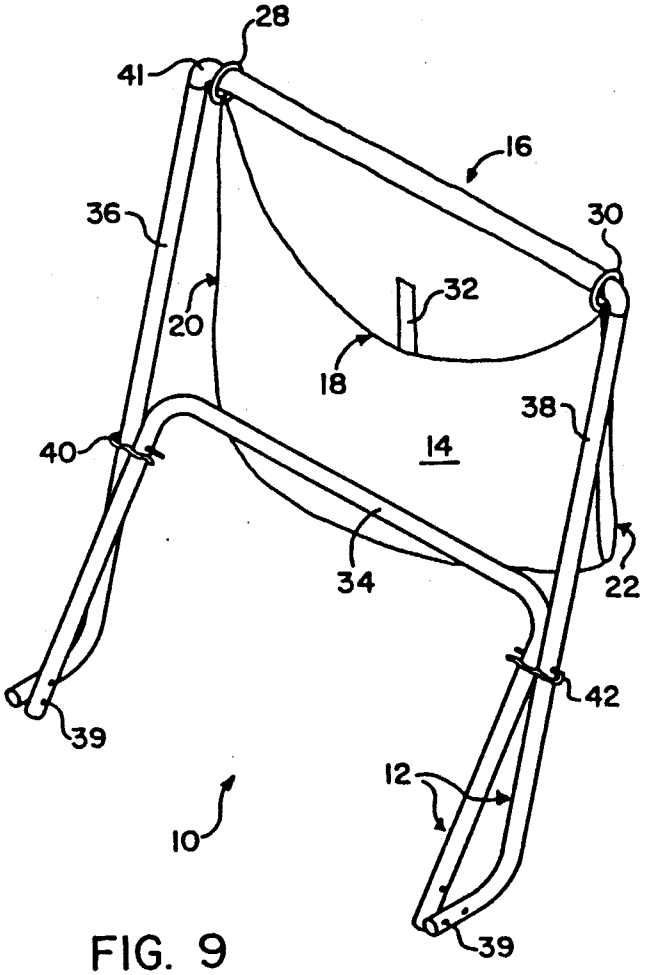
FIG. 9 is a plan view of the invention in the folded portable position.

The preferred embodiment of the present invention is illustrated by way of example in FIGS. 1-9. With specific reference to FIG. 1, a portable, asymmetrically displaced, self-centering, ball catcher and return 10 includes frame 12 and net 14. Net 14 has a top 16, a bottom 18, and two sides 20 and 22. Additionally, net 14 has bottom corners 24 and 26 to which are attached tether rings 28 and 30. Further, in a preferred embodiment, an appropriate target graphic 32 is attached, by any means known in the art, to net 14 to indicate a specific aiming point on net 14.

Figure 1:
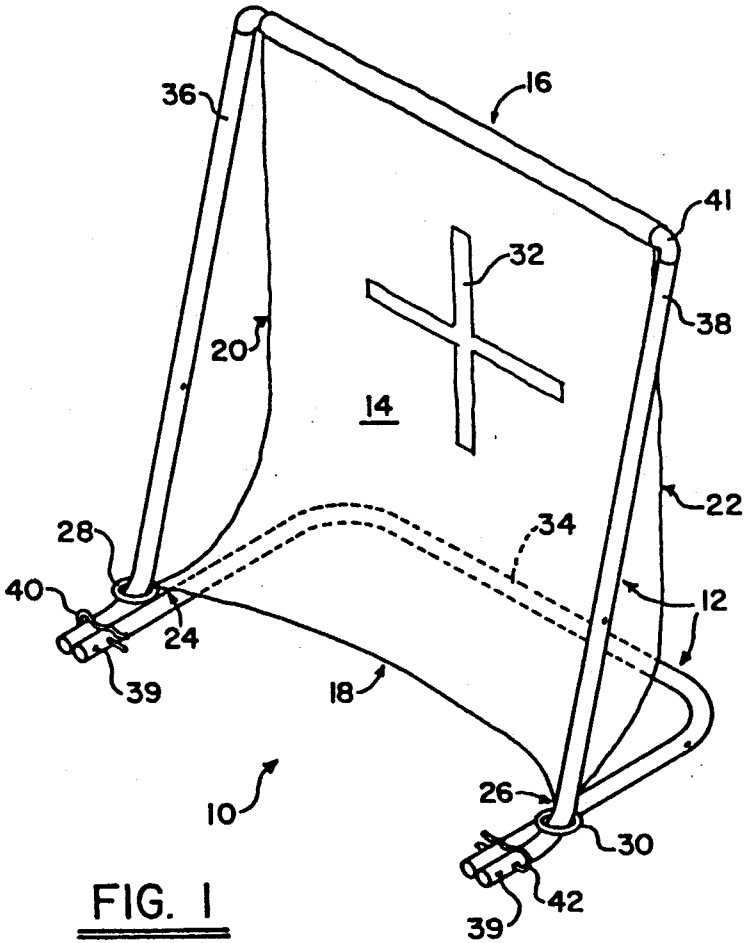
FIG. 1 is a plan view of a preferred embodiment of the portable, asymmetrically displaced self-centering catcher and return of the present invention.

Frame 12 is comprised of three basic parts, (1) a base; (2) uprights on either side of the base; and (3) a crossbar—from which the net hangs. A U-shaped horizontal base member 34 is the first part. In use, the open end of the U of horizontal member 34 faces the user. The second part is comprised of two oppositely positioned parallel vertical frame members 36 and 38. One end of each vertical frame member 36 and 38 is connected to base 34 at 39 in any manner known in the art that allows rotation. As shown in FIG. 1, when opened for use, retaining pins 40 and 42 pass through frame members 36 and 38 and base 34 and prevent movement of either. The union by pins 40 and 42 is designed so as to result in the vertical frame members 36 and 38 not only being supported in an upright position, but in a backwardly inclined position, as more clearly seen in FIGS. 4 through 8. Vertical frame members 36 and 38 are connected at the top by crossbar member 41 from which the top 16 of net 14 is suspended. The top 16 of net 14 is attached by any means known in the art across the length of top crossbar 41. Net 14 hangs from crossbar 41 down to the surface upon which U-shaped horizontal member 34 rests.

Figure 3:
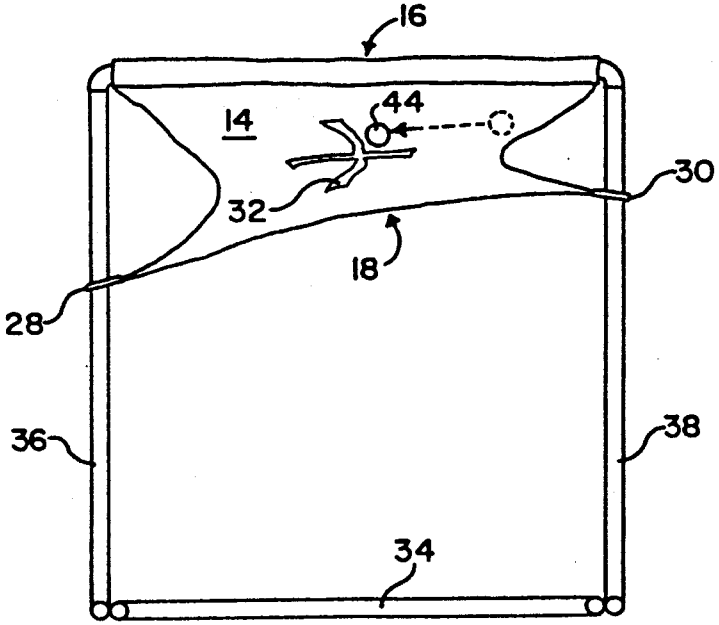
FIG. 3 shows the mishit ball being centered in the net with the net in the raised position.
Figure 2:
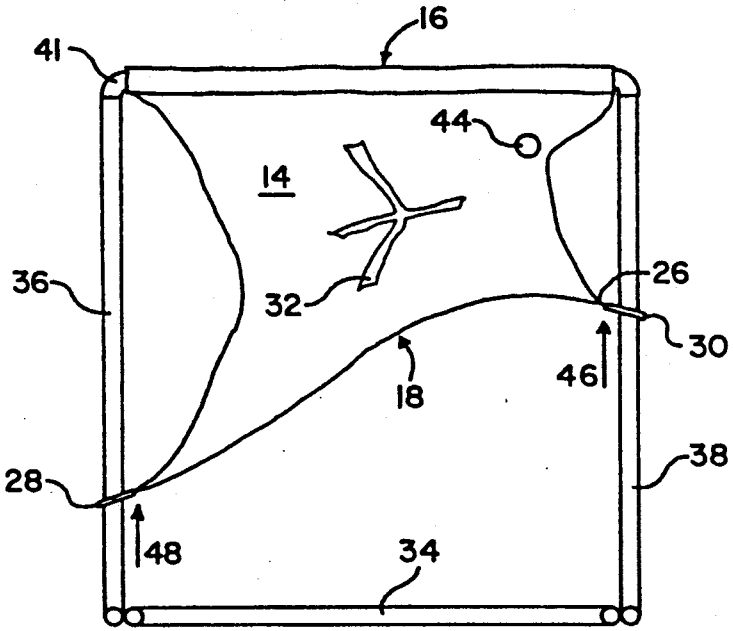
FIG. 2 is a front view illustrating the asymmetrical displacement and self-centering action of the invention when a ball is hit off center into the net.

Referring now to FIGS. 2 and 3, the asymmetrical displacement and self-centering function of portable, asymmetrically displaced, self-centering, ball catcher and return 10 is illustrated. As will be the case with most amateur golfers, football kickers, or "ball propellers" of any type, perfect accuracy will evade the user more often than not. FIG. 2 illustrates the typical result of an amateur golfer attempting to hit target 32 on net 14. That is, ball 44 has impacted net 14 well off center, in this case to the right of the target 32. Because the bottom corners 24 and 26 are free to move asymmetrically and independently along the length of vertical frame members 36 and 38, and because the sides 20 and 22 of net 14 are not restricted in any way, net 14 self-centers ball 44. That is, the momentum of ball 44 pulls bottom corner 26 and tether ring 30 upward in the direction of arrow 46 farther than tether 28, as shown by the displacement arrow 48. Because net 14 is allowed to respond to this momentum asymmetrically, by being so loosely attached to frame and because there is a tension created by the impact of the ball which is strongest all around the perimeter of the net and weakest in the center of the net, the ball moves within the net toward the lesser tension, i.e. the center. Net tension will always be greater toward the perimeter (sides, top & bottom) therefore the ball will always move toward the center of the net where tension is least.

Because the net is fixed at the top, its movement is restrained across the whole width of the net. The bottom and sides of net are limited by the slidable rings. It should be noted that although the sides of the net do move and react to the impact of the ball, there is a tension along both sides of the net. This tension, is least felt by the center of the net since it is physically farthest from the side. Therefore, a ball impacting off center will move in the path of least resistance toward the center of the net.

Referring now to FIG. 3, ball 44 has been aided in its movement by the asymmetrical, independent functioning of tether rings 28 and 30 toward the center of net 14. The device is now in the position to perform the ball return function, as discussed further hereafter.

Figure 4:
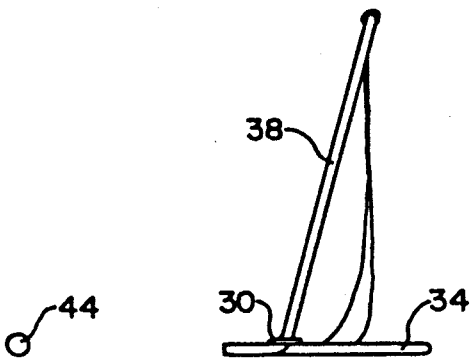
FIG. 4 is a side view of FIG. 1 showing the device at rest.

Referring now to FIGS. 4 through 8, this ball return function of the invention is illustrated. FIG. 4 shows a ball 44, a golf ball in this embodiment, located several feet in front of portable, asymmetrically displaced, self-centering, ball catcher and return 10. Net 14 is attached at top 16 to frame 12 and hangs directly down from crossbar 41 spanning vertical frame members 36 and 38. Once again, the backward incline of vertical frame members 36 and 38 is clearly illustrated. Importantly, no excess netting is utilized in the invention. That is, only the very first few inches of the bottom 18 of net 14 actually touches the surface. The net 14 hangs from crossbar 41 straight down but since the top of the net 14 is positioned rearward of the bottom 18 and because the net 14 is slightly longer than the straight line distance from crossbar 41 to the ground, the net 14 hangs in a ramp-like configuration with the bottom few inches laying flat on the surface. The displacement of the top and bottom is what determines the direction the ball 44 takes back to a user when bottom 18 of net 14 falls to the ground.

Figure 6:
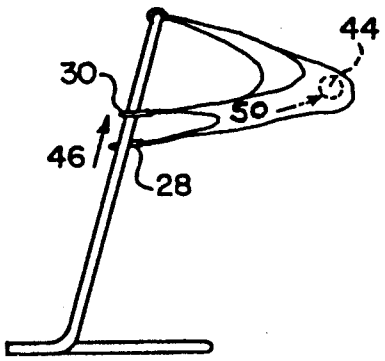
FIG. 6 is a side view showing the ball stopped by the net and the bottom of the net in the asymmetrically raised position.
Figure 5:
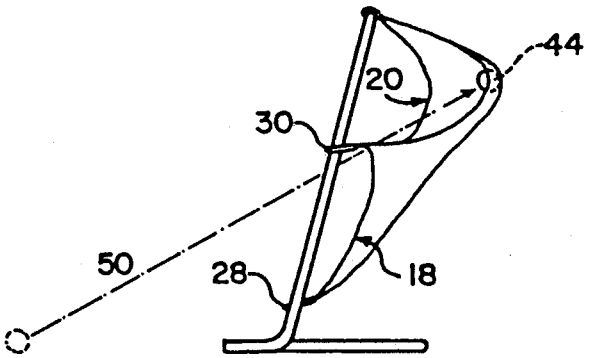
FIG. 5 is a side view showing a ball initially contacting the net.

Referring to FIG. 5, ball 44 has been propelled in the direction of arrow 50 into net 14 in an off-center hit, as represented in the front view in FIG. 2. Again, the asymmetrical displacement and self-centering tether rings 28 and 30 are allowed to respond asymmetrically and independently as are the unbound sides 20 and 22 of the net 14. FIG. 6 shows ball 42 centered and tether rings 30 and 28 in a raised position, demonstrated by arrow 46. The mass of the tether rings and slight frictional resistance to the upward movement caused by the momentum of ball 44, the air resistance and mass of net 14, and the stability of the frame 12 cause ball 44 to cease its rearward movement in the direction of arrow 50, at this point.

Figure 7:
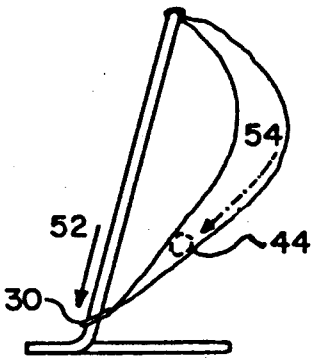
FIG. 7 is a side view showing the captured ball dropping down as the bottom of the net drops towards the ground surface.

The ball has been arrested in the net (FIG. 6) and gravity causes it to fall. It is, however, within the confines of the net 14 and will fall only as the net 14 recedes. Since gravity is also acting simultaneously on the tether rings 28 and 30, net 14, and the ball 44, they all fall together. When the rings and net have hit the bottom limits of their range, they form a ramp-like configuration which changes the direction of the ball as it rolls out of the net by 90 degrees so it rolls along the surface (i.e., floor/ground) back toward the user. The relationship of the rings to the ball cause the ball to fall toward the rings and, by extension, toward the user. As shown in FIG. 7, tether rings 30 and 28 (not shown) begin to fall down vertical frame members 36 and 38 in unison, albeit from different heights, in the direction of arrow 52. This downward movement and the force of gravity acting on ball, rings, and net, imparts some momentum back to ball 44 in the direction shown by arrow 54 (in FIG. 8). Because the bottom of the net is guided forward (from crossbar to base) along uprights 36 and 38, this dictates the direction the ball is to take, i.e. back to user.

Figure 8:
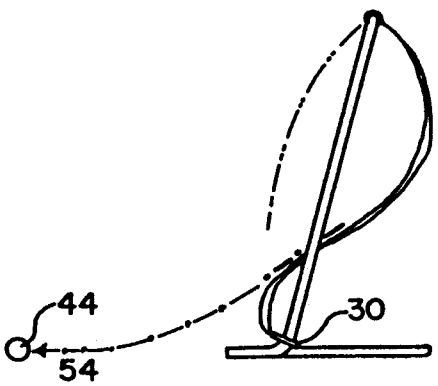
FIG. 8 is a side view illustrating the ball return aspect of the invention.

Referring now to FIG. 8, tether rings 28 and 30 have returned to their lowered position at the bottom of vertical frame members 36 and 38, and because net bottom 18 lays flat on the surface, ball 44 rolls out of the net back to the user. As shown in dotted lines in FIG. 8, net 14 actually falls back down to the surface, and goes through vertical frame members 36 and 38, toward the user, then settles back to its rest position (See FIG. 4).

In use, a golfer, soccer player, football player, etc., sets up the lightweight, portable, asymmetrically displaced, self-centering, ball catcher and return of the present invention by placing U-shaped base 34 on the ground surface with the open end pointed towards the ball. Although there are other methods of assembly, a preferred method is to slide tether rings 28 and 30 over vertical frame members 36 and 38, respectively. The top 16 of net 14 is then connected to crossbar 41 in any suitable manner. One such manner is to slip crossbar 41 through a hem of net at the top 16 of net 14 thereby securing top 16 to crossbar 41. Crossbar 41 then is attached at its opposite ends to vertical frame members 36 and 38.

Referring now to FIG. 9, the ball catcher and return 10 of the invention is shown in its folded, portable, storage state. In this position retaining pins 40 and 42 hold U-shaped horizontal base member 34 in an upwards position compactly against vertical frame members 36 and 38. When assembling the device for use, retaining pins 40 and 42 are removed, U-shaped horizontal base 34 is allowed to drop to the surface, as shown in FIG. 1, and retaining pins 40 and 42 are reinserted through aligned holes in base 34 and frame members 36 and 38. The retaining pins 40 and 42 restrain further relative motion between horizontal base member 34 and vertical frame members 36 and 38 in this position. At this point, net 14 is secured along its top 16 to crossbar 41 and is now joined to vertical frame members 36 and 38 at only its corners by tether rings 28 and 30. A user now is free to propel the ball into the net with the certainty that the net and frame will stop the ball and that the ball will be returned back to the user so that a single ball may be used again and again instead of needing to use and pick up a large number of balls. Further, by means of automatic, asymmetrically displaced, self-centering, ball catcher and return 10 of the present invention, there is no need to go to the device to recover the ball because the ball is returned to the user.

The asymmetrical displacement and self-centering action of the invention is most apparent and useful when users are unable to hit the center of target 32. Therefore, the device is useful for the vast majority of amateur golfers, soccer players, football kickers, etc. When ball 44 strikes net 14 to one side or the other of the target's center, either high or low, the asymmetrically reflexive action of the net, tethered only at the bottom corners, enables the net to perform the self-centering function. That is, again, the side into which the ball impacts results in that side's tether ring rising fastest and farther. This results in a configuration in the net that slides the ball towards the center of the net and target 32. At this point, the rearward momentum of the ball has been fully absorbed by: 1) the slight frictional resistance of the tether rings, 2) the air resistance to the movement of the net, 3) the mass of net, 4) the mass of the rings, and 5) the resistance to movement inherent in the frame on the surface. Obviously, as designed, the frictional resistance of the tether rings, their mass, the mass of the net and the air resistance to the movement of the net can be varied for specific needs such as for heavier items such as soccer balls, for example.

Once stopped, the downward movement of the loosely engaged tether rings 28 and 30, ball 44 and net 14 commences to return the ball to the user. As the tether rings reach the bottom of vertical frame members 36 and 38 and the bottom 18 of net 14 reaches the surface of the ground, the ball has forward momentum enough to carry it back essentially to the area where the ball was struck. At that point, the user can re-propel the same ball into the net and the cycle repeats itself.

While the portable, asymmetrically displaced, self-centering, catcher and return of the present invention has been disclosed primarily in connection for use with a golf ball, it should be appreciated that this catcher and return can be used with other balls. In particular, soccer, football, baseball, and any other ball throwing, kicking, or hitting situation where a stopping of the ball is required and some return movement of the ball is desired, this device is appropriate. Further, the simplicity of the invention and its inherent ability to be made of very durable, lightweight metal or plastic tubing and nylon netting of small proportions, make it useful not only outdoors but indoors. Further, there is no requirement that the device be secured to the ground, other than resting it upon the ground surface.

While the present invention has been disclosed in connection with the preferred embodiment thereof, it should be understood that there may be other embodiments which fall within the spirit and scope of the invention as defined by the following claims.

I claim:

1. A portable, asymmetrically displacable, self-centering ball catcher and return apparatus comprising:
   a) a frame adapted to the supported upright on a support surface; and
   b) a net means with a top bottom and two sides to define a pair of top corners and a pair of bottom corners, said net being attached to said frame at said top of said net means and slidably attached to said frame only at said bottom corners so that said corners and two sides are free to move asymmetrically and independently.

2. The apparatus of claim 1 wherein said frame further comprises:
   a) a U-shaped horizontal member; and
   b) two oppositely positioned vertical frame members attached to said U-shaped horizontal member at one end and to a horizontal crossbar at another end so as to form an upwardly standing, backwardly inclining frame for said net means.

3. The apparatus of claim 2 wherein said connection of the bottom corners of said net means further comprises a pair of independently moveable attachment means, one each attached to said oppositely positioned vertical frame members, so that said attachment means are free to rise and fall along the entire upward length of said vertical frame members.

4. The apparatus of claim 3 wherein said net means is configured so that said bottom lies parallel to and upon the surface support.

5. The apparatus of claim 4 further comprising a target means on said net means.

6. A method of catching and returning a ball comprising the steps of:
   a) constructing a frame;
   b) attaching a net means, with a top and a bottom and two sides, which define a pair of top corners and a pair of bottom corners to said frame along the top of said net means and slidably attaching two only said pair of bottom corners to said frame so that said bottom and two sides are free to move asymmetrically and independently of each other; and c) a user propelling a ball into said net means so that said net means moves asymmetrically and independently to guide said ball toward the center of said net means, and cause said ball to roll to the ground surface, and roll on the ground, and back toward said user.

7. The method of claim 6 wherein the step of constructing a frame further comprises the steps of:

a) constructing a U-shaped horizontal member; and b) attaching two oppositely positioned vertical frame members to said U-shaped horizontal member at one end and to a horizontal crossbar at another end so as to form an upwardly standing, backwardly inclining support for said net means.

8. The method of claim 7 wherein said connection of the corners of said net means further comprises the step of providing a pair of independently moveable attachment means, one each attached to said oppositely positioned vertical frame members, so that said attachment means are free to asymmetrically rise and fall along the entire upward length of said vertical frame members.

9. The method of claim 8 further comprising the step of configuring said net means so that bottom lies parallel to and upon the ground surface.

10. The method of claim 8 further comprising the step of attaching a target means to said net means.

* * * * *

UNITED STATES PATENT AND TRADEMARK OFFICE

CERTIFICATE OF CORRECTION

PATENT NO. : 5,193,802

DATED : March 16, 1993

INVENTOR(S) : James E. Saltus

It is certified that error appears in the above-identified patent and that said Letters Patent is hereby corrected as shown below:

Col. 6, line 37, add "and" after "top" and before "bottom"

Col. 8, line 12, insert --said-- after "that" and before "bottom"

Signed and Sealed this

Eighteenth Day of January, 1994

*Attest:*

Bruce Lehman

BRUCE LEHMAN

*Attesting Officer*

*Commissioner of Patents and Trademarks*